US005144932A

United States Patent [19]

Miyashita et al.

[11] Patent Number: 5,144,932

[45] Date of Patent: Sep. 8, 1992

[54] AIR-FUEL RATIO CONTROL METHOD FOR INTERNAL COMBUSTION ENGINES

[75] Inventors: Yukio Miyashita; Hiroshi Mifune; Atsushi Matsubara, all of Wako, Japan

[73] Assignee: Honda Giken Kogyo Kabushiki Kaisha, Tokyo, Japan

[21] Appl. No.: 765,614

[22] Filed: Sep. 25, 1991

[30] Foreign Application Priority Data

Sep. 26, 1990 [JP] Japan ..... 2-256427

[51] Int. Cl.[5] ..... F02D 41/14

[52] U.S. Cl. ..... 123/695

[58] Field of Search ..... 123/440, 489, 589

[56] References Cited

U.S. PATENT DOCUMENTS 4,528,961 7/1985 Katoh et al. ..... 123/489
4,644,921 2/1987 Kobayashi et al. ..... 123/489
4,739,740 4/1988 Ohkawara et al. ..... 123/489
4,763,629 8/1988 Okazaki et al. ..... 123/489
4,887,575 12/1988 Takahashi ..... 123/489 X
5,033,440 7/1991 Kumagai et al. ..... 123/489
5,077,971 1/1992 Kimagai et al. ..... 123/489 X

FOREIGN PATENT DOCUMENTS 61-232347 10/1986 Japan .

*Primary Examiner*—Willis R. Wolfe
*Attorney, Agent, or Firm*—Armstrong & Kubovcik

[57] ABSTRACT

An air-fuel ratio control method for an internal combustion engine. The air-fuel ratio of an air-fuel mixture supplied to the engine is feedback-controlled to a desired air-fuel ratio in response to output from an exhaust gas ingredient concentration sensor. When the desired air-fuel ratio is to be changed in a leaning direction from a value equal to or leaner than a stoichiometric air-fuel ratio, it is changed at a larger rate until it reaches a predetermined value than after it has reached the predetermined value. The predetermined value is set to a value slightly leaner than an air-fuel ratio at which the amount of emission of $NO_X$ increases.

6 Claims, 6 Drawing Sheets

| FIG.3a | FIG.3b | FIG.3c |
|---|---|---|

AIR-FUEL RATIO CONTROL METHOD FOR INTERNAL COMBUSTION ENGINES

BACKGROUND OF THE INVENTION

The present invention relates to a method of controlling the air-fuel ratio of an air-fuel mixture supplied to an internal combustion engine, and more particularly, to a method of this kind wherein the air-fuel mixture supplied to the engine is feedback-controlled to a desired air-fuel ratio in response to the output of an exhaust gas ingredient concentration sensor having output characteristics in approximate proportion to the exhaust gas ingredient concentration.

Among conventional methods for feedback-controlling the air-fuel ratio of an air-fuel mixture supplied to an internal combustion engine (hereinafter referred to as "supply air-fuel ratio") to a desired air-fuel ratio in response to the output of an exhaust gas ingredient concentration sensor having output characteristics proportional to the exhaust gas ingredient concentration, there is a method proposed by Japanese Provisional Patent Publication (Kokai) No. 63-12850 wherein in changing the desired air-fuel ratio, the rate of change (speed of change) is changed over between a case in which the desired air-fuel stoichiometric air-fuel ratio (e.g. 14.7) and a case in which it is changed in an opposite direction (i.e. from a lean air-fuel patio to the stoichiometric air-fuel ratio).

The desired air-fuel ratio is changed to a lean value with respect to the stoichiometric value, for example, when the engine shifts to a predetermined partial load condition such as a so-called "lean burn" region to save the fuel consumption.

However, according to the proposed method, in changing the desired air-fuel ratio in the leaning direction from the stoichiometric air-fuel ratio, the rate of change is set to a constant value over the entire air-fuel ratio range on the lean side of the stoichiometric air-fuel ratio. Therefore, if the rate of change is set to a small value in order to prevent a torque shock from occurring due to a drastic change in the desired air-fuel ratio, there arises a problem that a time period is prolonged during which the desired air-fuel ratio assumes intermediate values, e.g. 16 and values in its vicinity an increase in the amount of emission of $NO_X$. On the other hand, if the rate of change is set to a large value in order to curb the increase in the amount of emission of $NO_X$, the torque shock increases, which results in degraded driveability.

SUMMARY OF THE INVENTION

It is the object of the invention to provide an air-fuel ratio control method for an internal combustion engine, which is capable of properly setting the rate of change in the desired air-fuel ratio when the desired air-fuel ratio is changed in a leaning direction from a stoichiometric air-fuel ratio, so as to reduce the amount of emission of $NO_X$ while preventing the torque shock from increasing.

To attain the above object, the invention provides an air-fuel ratio control method for an internal combustion engine having an exhaust passage, and an exhaust gas ingredient concentration sensor arranged in the exhaust passage for detecting the concentration of an ingredient in exhaust gases from the engine, wherein the air-fuel ratio of an air-fuel mixture supplied to the engine is feedback-controlled in response to output from the exhaust gas ingredient concentration sensor to a desired air-fuel ratio dependent on operating conditions of the engine.

The air-fuel ratio control method according to the invention is characterized by comprising the steps of:

(1) determining whether or not the desired air-fuel ratio is to be changed in a leaning direction from a value equal to or leaner than a stoichiometric air-fuel ratio; and (2) changing the desired air-fuel ratio at a larger rate until the desired air-fuel ratio reaches a predetermined value than after the desired air-fuel ratio has reached the predetermined value, when the desired air-fuel ratio is to be changed in the leaning direction from the value equal to or leaner than the stoichiometric air-fuel ratio.

Preferably, the predetermined value is set to a value slightly leaner than an air-fuel ratio at which the amount of emission of $NO_X$ increases.

The exhaust gas ingredient concentration sensor has output characteristics approximately proportional to the concentration of the ingredient in the exhaust gases.

For example, an amount of fuel supplied to the engine is determined by multiplying a basic fuel amount by a desired air-fuel ratio coefficient set in response to operating conditions of the engine and representing the desired air-fuel ratio and an air-fuel ratio correction coefficient calculated based on the desired air-fuel ratio coefficient and the output from the exhaust gas ingredient concentration sensor, to thereby feedback-control the air-fuel ratio of the mixture to the desired air-fuel ratio.

Specifically, the determination at the step (1) as to whether or not the desired air-fuel ratio is to be changed in the leaning direction from the value equal to or leaner than the stoichiometric air-fuel ratio comprises the steps of:

(1-1) determining whether or not an immediately preceding value of the desired air-fuel ratio coefficient is smaller than a value corresponding to the stoichiometric air-fuel ratio; and (1-2) determining whether or not a difference between a provisional present value of the desired air-fuel ratio and the immediately preceding value of the desired air-fuel ratio obtained by subtracting the latter from the former is smaller than 0.

Also specifically, the changing of the desired air-fuel ratio at the step (2) comprises the steps of:

(2-1) determining whether or not the immediately preceding value of the desired air-fuel ratio coefficient is larger than a value corresponding to the predetermined value of the desired air-fuel ratio;

(2-2) setting a decremental variable of the desired air-fuel ratio to a first predetermined value, when the immediately preceding value of the desired air-fuel ratio coefficient is larger than the value corresponding to the predetermined value of the desired air-fuel ratio;

(2-3) setting the decremental variable to a second predetermined value smaller than the first predetermined value, when the immediately preceding value of the desired air-fuel ratio coefficient is equal to or smaller than the value corresponding to the predetermined value of the desired air-fuel ratio;

(2-4) determining whether or not the absolute value of the difference between the provisional present value and the immediately preceding value of the desired air-fuel ratio coefficient is smaller than the decremental variable set at the step (2-2) or (2-3); and (2-5) obtaining a present value of the desired air-fuel ratio coefficient by subtracting the decremental variable set at the step (2-2) or (2-3) from the immediately preceding value of the desired air-fuel ratio coefficient, when the absolute value of the difference between the provisional present value and the immediately preceding value of the desired air-fuel ratio coefficient is equal to or larger than the decremental variable set at the step (2-2) or (2-3).

The above and other objects, features and advantages of the invention will become more apparent from the ensuing detailed description taken in conjunction with the accompanying drawings.

DETAILED DESCRIPTION

The method according to the invention will now be described in detail with reference to the drawings showing an embodiment thereof.

Figure 1:
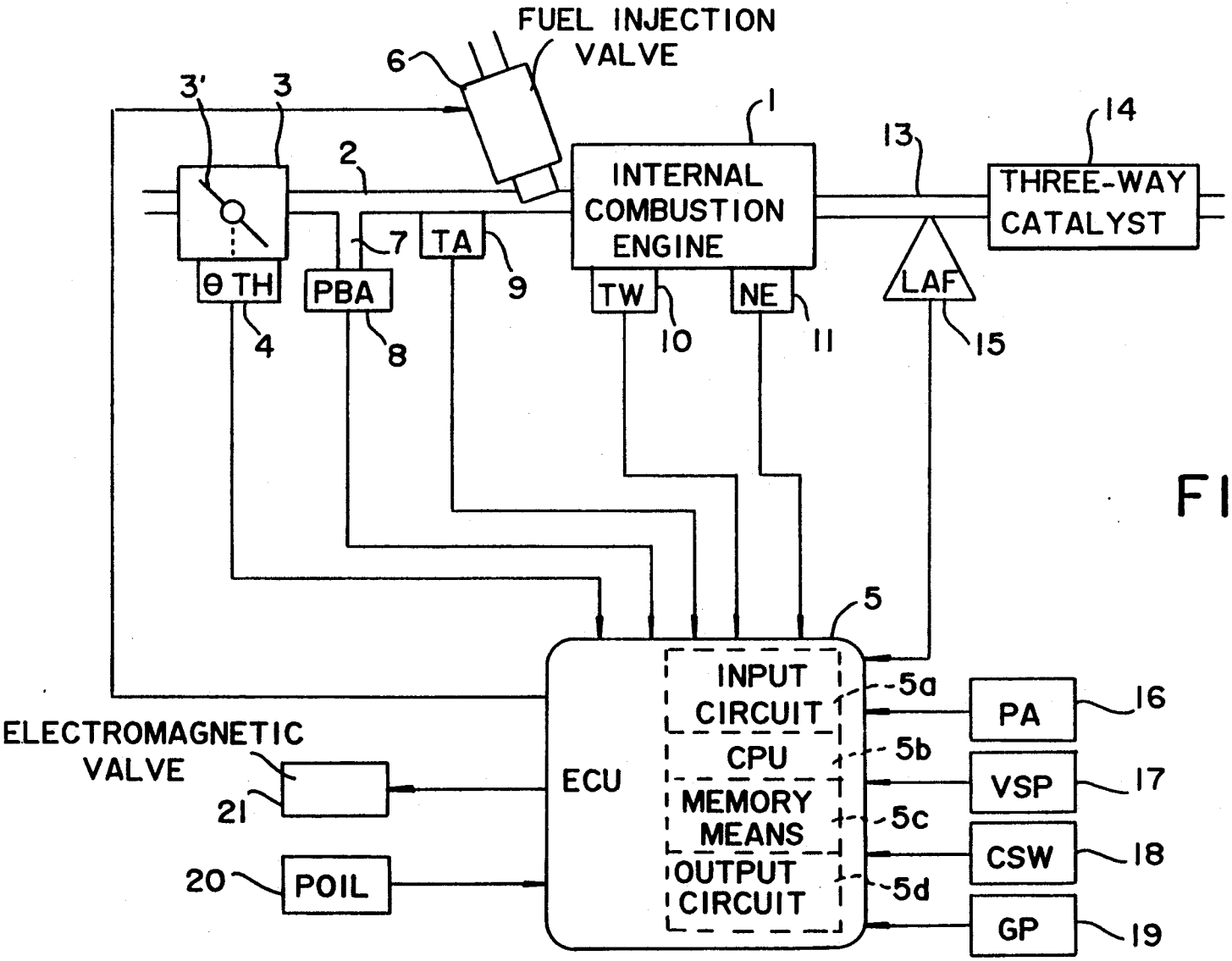
FIG. 1 is a block diagram illustrating the whole arrangement of a fuel supply control system for carrying out the control method of the invention.

Referring first to FIG. 1, there is shown the whole arrangement of a fuel supply control system which is adapted to carry out the control method of this invention. In the figure, reference numeral designates a DOHC straight type four cylinder engine, each cylinder being provided with a pair of intake valves and a pair of exhaust valves, not shown. This engine 1 is arranged such that the operating characteristics of the intake valves and exhaust valves (more specifically, the valve opening period and the lift (generically referred to hereinafter as "valve timing") permit selection between a high speed valve timing adapted to a high engine speed region and a low speed valve timing adapted to a low engine speed region.

In an intake pipe 2 of the engine 1, there is arranged a throttle body 3 accommodating a throttle body 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6 are each provided for each cylinder and arranged in the intake pipe 2 between the engine 1 and the throttle valve 3' and at a location slightly upstream of an intake valve, not shown. The fuel injection valves 6 are connected to a fuel pump, not shown, and electrically connected to the ECU 5 to have their valve opening periods controlled by signals therefrom.

An electromagnetic valve 21 is connected to the output side of the ECU 5 to selectively control the aforementioned valve timing, the opening and closing of this electromagnetic valve 21 being controlled by the ECU 5. The valve 21 selects either high or low hydraulic pressure applied to a valve timing selection mechanism, not shown. Corresponding to this high or low hydraulic pressure, the valve timing is thereby adjusted to either a high speed valve timing or a low speed valve timing. The hydraulic pressure applied to this selection mechanism is detected by a hydraulic pressure (oil pressure) (POIL) sensor 20 which supplies a signal indicative of the sensed hydraulic pressure to the ECU 5.

Further, an intake pipe absolute pressure (PBA) sensor 8 is provided in communication with the interior of the intake pipe 2 via a conduit 7 at a location immediately downstream of the throttle valve 3' for supplying an electric signal indicative of the sensed absolute pressure to the ECU 5. An intake temperature (TA) sensor 9 is inserted into the intake pipe 2 at a location downstream of the intake pipe absolute pressure sensor 8 for supplying an electric signal indicative of the sensed intake temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the ECU 5.

Further electrically connected to the ECU 5 are an atmospheric pressure (PA) sensor 16, a vehicle speed sensor 17, a clutch sensor 18 for detecting when the clutch is engaged and disengaged, and a gear position sensor 19 for detecting the shift position of a transmission, not shown. The signals from all these sensors are supplied to the ECU 5.

The ECU 5 comprises an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed in the CPU 5*b* and for storing results of calculations therefrom, etc., and an output circuit 5*d* which outputs driving signals to the fuel injection valves 6 and the electromagnetic valve 21.

The CPU 5*b* operates in response to the abovementioned signals from the sensors to determine operating conditions in which the engine 1 is operating such as an air-fuel ratio feedback control region and open-loop control regions, and calculates, based upon the determined operating conditions, the valve opening period or fuel injection period $T_{OUT}$ over which the fuel injection valves 6 are to be opened by the use of the following equation (1) in synchronism with inputting of TDC signal pulses to the ECU 5:

$$T_{OUT}=Ti\times KCMDM\times KLAF\times K_1+K_2 \quad (1)$$

where

Ti represents a basic fuel amount, more specifically a basic fuel injection period which is determined according to the engine rotational speed Ne and the intake pipe absolute pressure PBA. The value of Ti is determined by a Ti map stored in the memory means 5c.

KCMDM is a modified desired air-fuel ratio coefficient which is set by means of a program shown in FIG. 2, described hereinafter, according to engine operating conditions, and calculated by multiplying a desired air-fuel ratio coefficient KCMD representing a desired air-fuel ratio by a fuel cooling correction coefficient KETV. The correction coefficient KETV is intended to apply a prior correction to the fuel injection amount in view of the fact that the supply air-fuel ratio varies due to the cooling effect produced when fuel is actually injected, and its value is set according to the value of the desired air-fuel ratio coefficient KCMD. Further, as will be clear from the aforementioned equation (1), the fuel injection period $T_{OUT}$ increases if the desired fuel-air injection ratio coefficient KCMD increases, so that the values of KCMD and KCMDM will be in direct proportion to the reciprocal of the air-fuel ratio A/F.

KLAF is an air-fuel ratio correction coefficient which is set such that the air-fuel ratio detected by the LAF sensor 15 during air-fuel ratio feedback control coincides with the desired air-fuel ratio, and is set to predetermined values depending on engine operating conditions during open-loop control.

$K_1$ and $K_2$ are other correction coefficients and correction variables, respectively, which are calculated based on various engine parameter signals to such values as to optimize characteristics of the engine such as fuel consumption and accelerability depending on engine operating conditions.

The CPU 5b outputs a valve timing selection command signal depending on engine operating conditions, which causes opening and closing of the electromagnetic valve 21.

The CPU 5b performs calculations as described hereintofore, and supplies the fuel injection valves 6 and electromagnetic valve 21 with driving signals based on the calculation results through the output circuit 5d.

Figure 2:
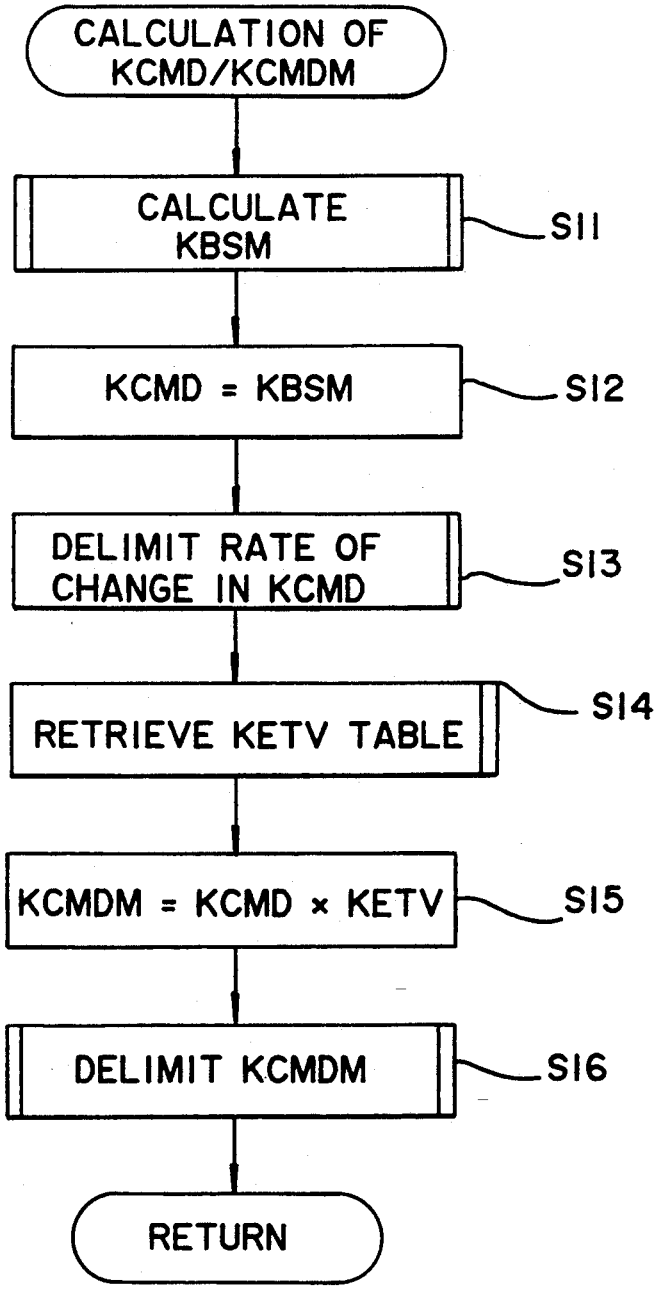
FIG. 2 is a flowchart of a program for calculating a desired air-fuel ratio coefficient (KCMD) and a modified desired air-fuel ratio coefficient (KCMDM)

FIG. 2 shows a flowchart of a program which calculates the desired air-fuel ratio coefficient KCMD and modified air-fuel ratio coefficient KCMDM, when the engine is in a normal operating condition other than a predetermined high load operating condition in which the fuel supply to the engine should be increased or a predetermined low load operating condition in which the fuel supply to the engine should be cut off. This program is carried out in synchronism with inputting of each TDC signal pulse to the ECU 5.

At a step S11, a basic value KBSM of the desired air-fuel ratio coefficient is calculated, and the calculated basic value KBSM is set as a value of the desired air-fuel ratio coefficient KCMD at a step S12. The calculation of the basic value KBSM at the step S11 is carried out by reading, from a KBSM map in which values of the basic value KBSM are set in accordance with the engine rotational speed NE and the intake pipe absolute pressure PBA, a value corresponding to a detected value of the engine rotational speed NE and a detected value of the intake pipe absolute pressure PBA (or an estimated PBA value disclosed e.g. in Japanese Provisional Patent Publication (Kokai) No. 60-90948. At a step S13, delimiting of the value of the coefficient KCMD is carried out by a program described hereinafter with reference to FIG. 3 such that the difference between the immediately preceding value and the present value of the coefficient KCMD does not exceed an upper limit value set in accordance with engine operating conditions in order to prevent the value of the coefficient KCMD from being drastically changed. However, in the system according to the embodiment, under a condition that the coefficient KCMD assumes a value leaner than the stoichiometric air-fuel ratio, if the accelerator pedal is violently stepped on or in like cases, the value of the coefficient KCMD is immediately increased to a value corresponding to the stoichiometric air-fuel ratio.

Following the delimiting of the value of the coefficient KCMD, at a step S14, a value of the fuel cooling correction coefficient KETV is read from a table, not shown, in which values of the coefficient KETV are set in accordance with the coefficient KCMD, and the value of the coefficient KCMD is multiplied by the obtained value of the coefficient KETV to thereby calculate the modified desired air-fuel ratio coefficient KCMDM at a step S15. Then, limit checking of a value of the coefficient KCMDM is carried out at a step S16, followed by terminating the present program. In the limit checking, it is determined whether or not the value of the coefficient KCMDM falls within a range defined by predetermined upper and lower limit values, and if the value is outside the range, the coefficient KCMDM is set to the predetermined upper or lower limit value.

After execution of the present program, in another routine, not shown, when the engine is in a condition which enables to perform the air-fuel ratio feedback control, the air-fuel ratio correction coefficient KLAF is calculated such that an equivalent ratio KACT which is calculated based on the output from the LAF sensor 15 and representing a detected air-fuel ratio will become equal to the obtained desired air-fuel ratio coefficient KCMD.

Figures 3, 3A:
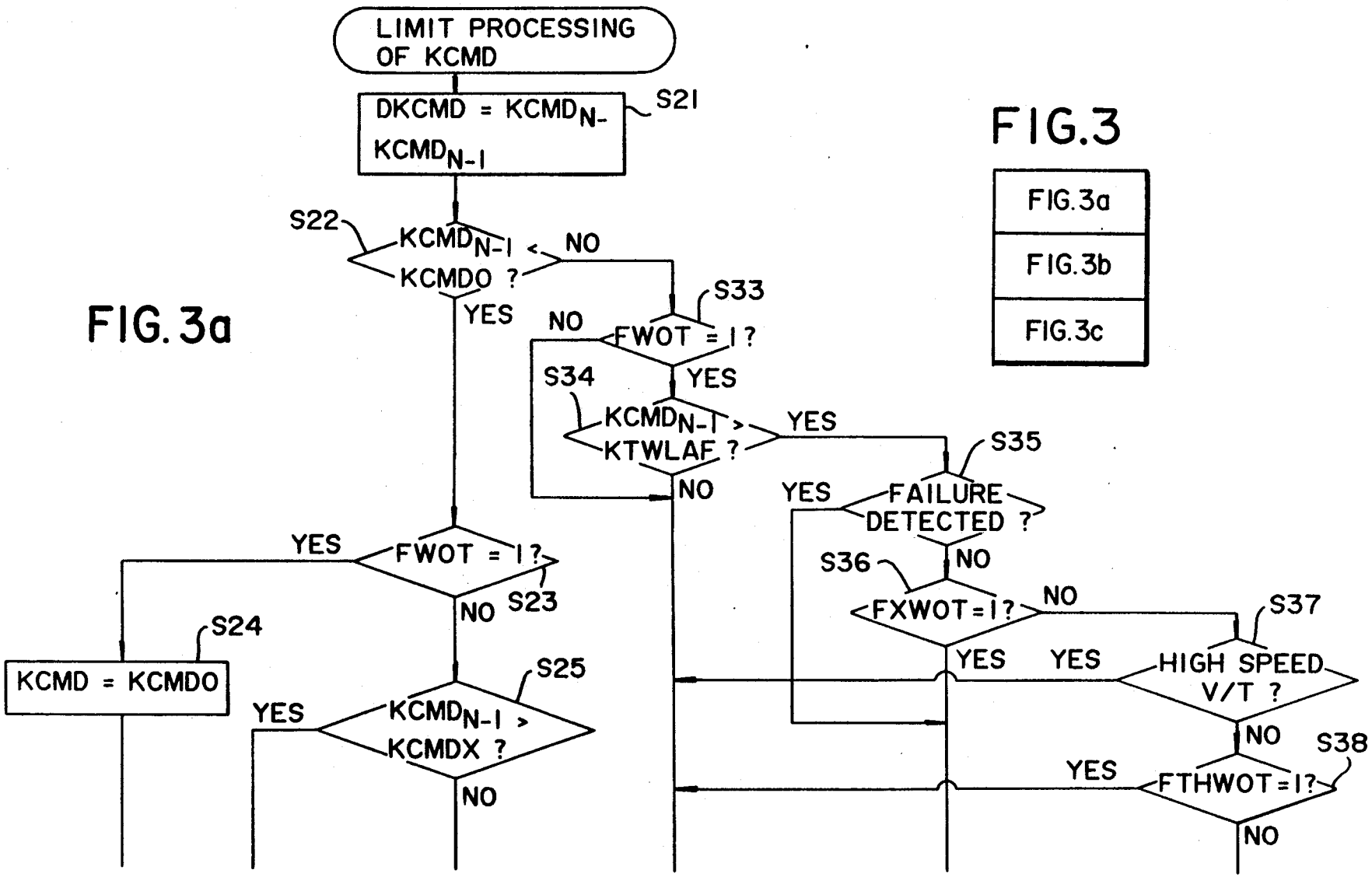
FIGS. 3, 3*a*, 3*b* and 3*c* are flowcharts of a program for carrying out limit processing of the desired air-fuel ratio coefficient.
Figure 3B:
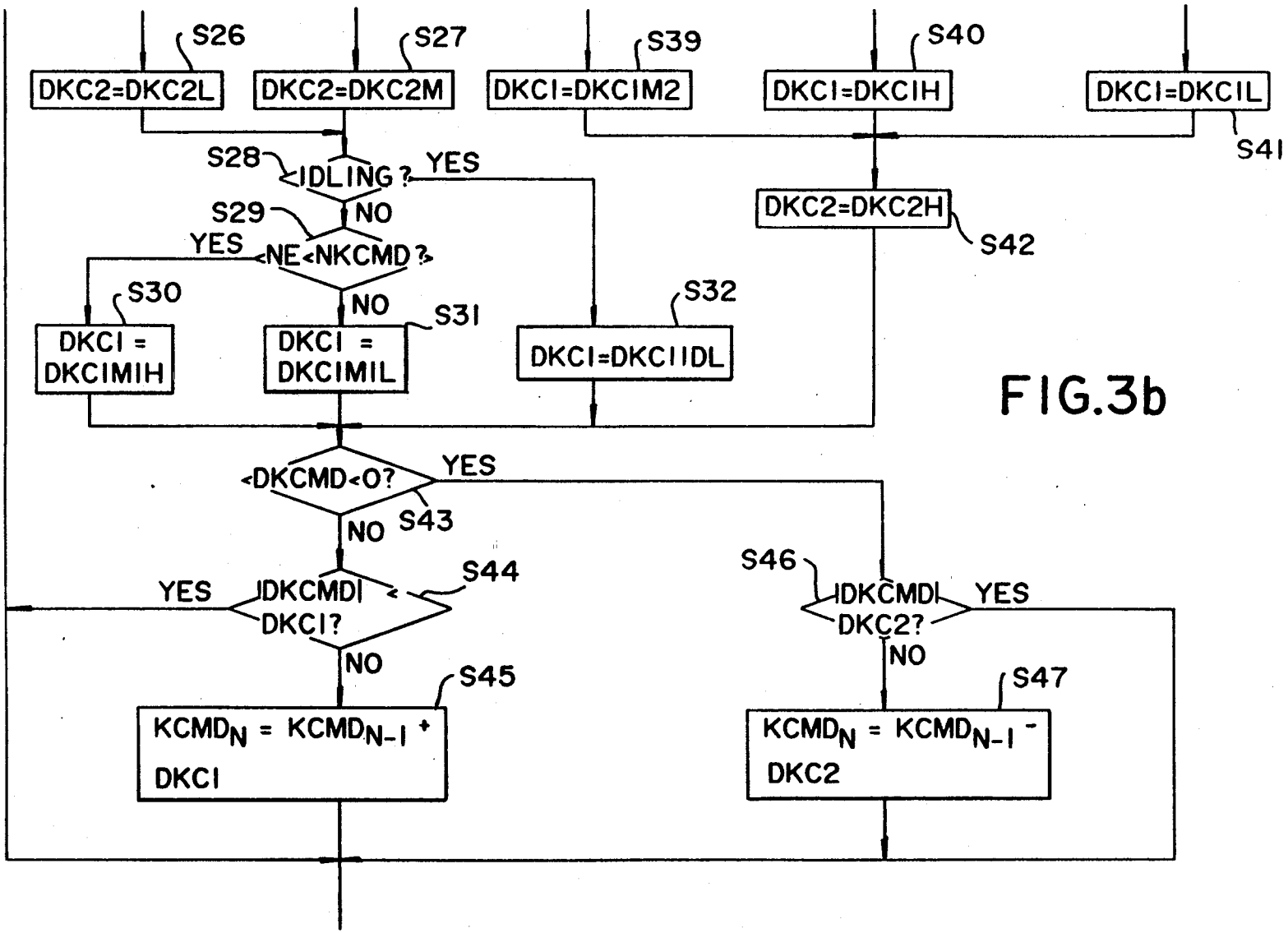
Figure 3C:
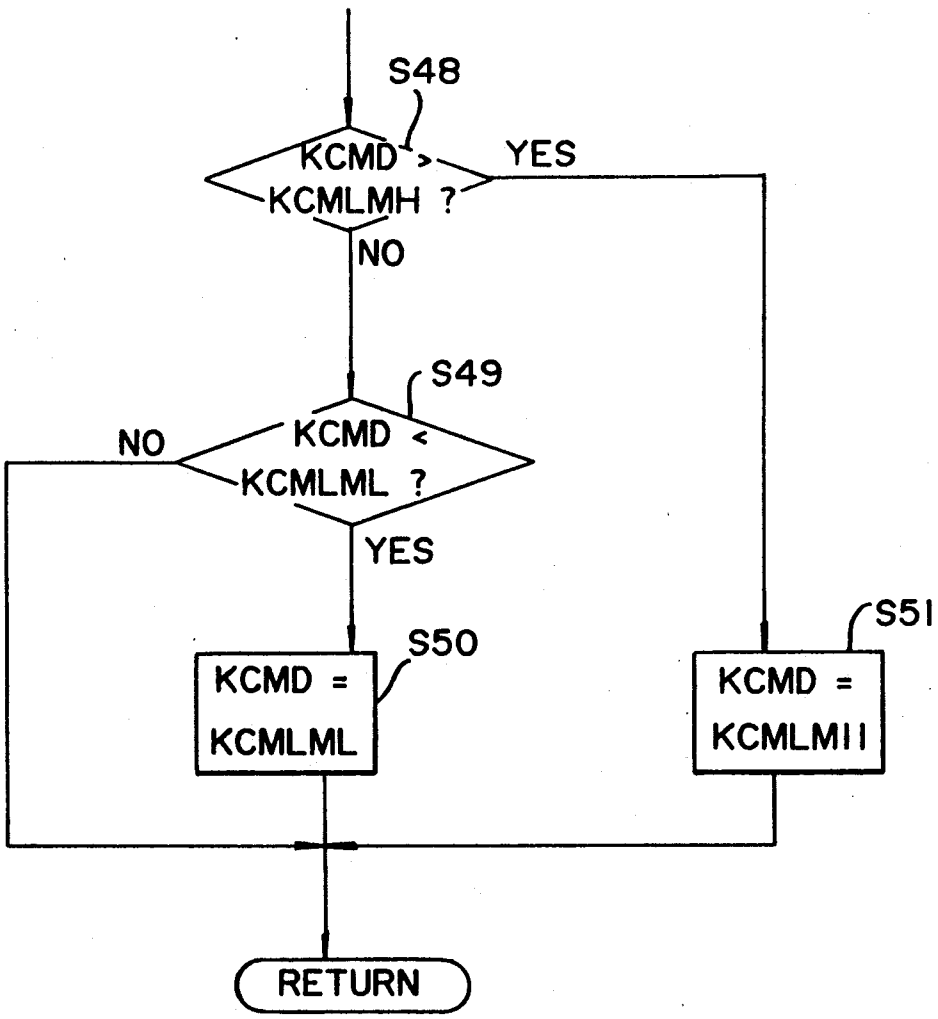

FIG. 3 shows a subroutine carried out at the step S18 in FIG. 2 to effect limit processing of the desired air-fuel ratio coefficient KCMD.

At a step S21, an amount of change DKCMD in the desired air-fuel ratio coefficient KCMD is calculated from a difference ($KCMD_N-KCMD_{N-1}$) between a present calculated value $KCMD_N$ and an immediately preceding value $KCMD_{N-1}$ calculated in the immediately preceding loop. Then at a step S22, it is determined whether or not the immediately preceding value $KCMD_{N-1}$ is smaller than a predetermined value KCMD0 corresponding to a stoichiometric air-fuel ratio. If the answer to this question is affirmative (Yes), i.e. if $KCMD_{N-1}<KCMD0$, which means that the desired air-fuel ratio assumes a value leaner than the stoichiometric air-fuel ratio, it is determined at a step S23 whether or not a WOT flag FWOT, which is set to a value of 1 when the engine is in a predetermined high load operating condition, i.e. the throttle value is substantially fully open or the intake pipe absolute pressure PBA is higher than a predetermined value, assumes a value of 1. If the answer to this question is affirmative (Yes), i.e. if FWOT=1, the desired air-fuel ratio coefficient KCMD is immediately set to the value KCMD0 corresponding to the stoichiometric air-fuel ratio, and then the program proceeds to a step S48.

Thus, if the desired air-fuel ratio coefficient KCMD assumes a value leaner than the value KCMD0 corresponding to the stoichiometric air-fuel ratio, and at the same time if FWOT=1, e.g. if the accelerator pedal is suddenly stepped on, the desired air fuel ratio coefficient KCMD is immediately increased to the value corresponding to the stoichiometric air-fuel ratio.

If the answer to the question of the step S23 is negative (No), i.e. if FWOT=0, it is determined whether or not the immediately preceding value $KCMD_{N-1}$ is larger than a predetermined lean value KCMDX (e.g. a value corresponding to A/F=17). If the answer to this question is affirmative (Yes), i.e. if $KCMD_{N-1}>KCMDX$, a decremental variable DKC2 equivalent to a rate of change in the desired air-fuel ratio in a leaning direction is set to a first predetermined decremental value DKC2L on the lean side (e.g. a value corresponding to A/F=0.3) at a step S26, followed by the program proceeding to a step S28. The decremental variable DKC2 is applied to an equation for calculating the present value $KCMD_N$ of the desired air-fuel ratio coefficient KCMD at a step S47, referred to hereinafter, to thereby decrease the desired air-fuel ratio coefficient KCMD. If the answer to the question of the step S25 is negative (No), i.e. if $KCMD_{N-1}\leqq KCMDX$, the decremental variable DKC2 is set to a second predetermined decremental value DKC2M on the lean side (e.g. a value corresponding to A/F=0.1) which is smaller than the first predetermined decremental value DKC2L at a step S27, followed by the program proceeding to the step S28.

At the step B28, it is determined whether or not the engine is idling. If the answer to this question is affirmative (Yes), an incremental variable DKC1 equivalent to a rate of change in the desired air-fuel ratio in an enriching direction is set to a predetermined incremental value DKC1IDL for idling (e.g. a value corresponding to A/F=2.0) at a step S32, and then the program proceeds to a step S43. The incremental variable DKC1 is applied to an equation for calculating the present value $KCMD_N$ of the desired air-fuel ratio coefficient KCMD at a step S45, referred to hereinafter, to thereby increase the desired air-fuel ratio coefficient KCMD. If the answer to the question of the step S28 is negative (No), i.e. if the engine is not idling, it is determined at a step S29 whether or not the engine rotational speed NE is lower than a predetermined value NKCMD (e.g. 1800 rpm). If the answer to this question is affirmative (Yes), the incremental variable DKC1 is set to a predetermined incremental value DKC1M1H for low engine rotational speed (e.g. a value corresponding to A/F=1.0) which is smaller than the predetermined incremental value DKC1IDL for idling. On the other hand, if the answer to this question is negative (No), the incremental variable DKC1 is set to a predetermined incremental value DKC1M1L for high engine rotational speed (e.g. a value corresponding to A/F=0.05) which is smaller than the predetermined incremental value DKC1M1H for low engine rotational speed at a step S31, followed by the program proceeding to the step S43.

At the step S43, it is determined whether or not the amount of change DKCMD in the desired air-fuel ratio coefficient KCMD has a negative value. If the answer to this question is affirmative (Yes), i.e. if the desired air-fuel ratio coefficient KCMD is changed in a decreasing direction, it is determined at a step S46 whether or not the absolute value of the difference DKCMD is smaller than the decremental variable DKC2. If the answer to this question is negative (No), i.e. if $|DKCMD|\geqq DKC2$, the present value $KCMD_N$ of the desired air-fuel ratio coefficient is changed to $(KCMD_{N-1}-DKC2)$ at a step S47, whereas if the answer is affirmative (Yes), the program immediately proceeds to the step S48.

If the answer to the question of the step S43 is negative (No), i.e. if $DKCMD\geqq 0$, which means that the desired air-fuel ratio coefficient KCMD is changed in an increasing direction, it is determined at a step S44 whether or not the absolute value of the amount of change DKCMD is smaller than the incremental variable DKC1. If the answer to this question is negative (No) i.e. if $|DKCMD|\geqq DKC1$ the present value $KCMD_N$ of the desired air-fuel ratio coefficient is changed to $(KCMD_{N-1}+DKC1)$ at a step S45, whereas if the answer is affirmative (Yes), the program immediately proceeds to the step S48.

According to the steps S43 to S47, if the absolute value of the amount of change DKCMD of the desired air-fuel ratio coefficient KCMD is larger than the incremental variable DKC1 or the decremental variable DKC2, the present value $DKCMD_N$ is changed to a value calculated by the use of the incremental variable DKC1 or the incremental variable DKC2, and the immediately preceding value $KCMD_{N-1}$ of the desired air-fuel ratio coefficient, to thereby prevent the desired air-fuel ratio coefficient KCMD from being drastically changed to degrade the driveability. In this sense, the incremental and decremental variables DKC1, DKC2 serve as limit values for delimiting the larger limit of the rate of change of the desired air-fuel ratio coefficient.

At steps S48 to S51, limit checking of the desired air-fuel ratio coefficient KCMD is carried out. More specifically, the desired air-fuel ratio coefficient KCMD is compared with predetermined upper and lower limit values KCMLMH, KCMLML at steps S48 and S49, respectively. If the desired air-fuel ratio coefficient KCMD has a value larger than the predetermined upper limit value KCMLMH, the desired air-fuel ratio coefficient KCMD is set to the predetermined upper limit value KCMLMH at a step S51, whereas if the desired air-fuel ratio coefficient KCMD has a value smaller than the predetermined lower limit value KCMLML, the desired air-fuel ratio coefficient KCMD is set to the predetermined lower limit value KCMLML at a step S50, followed by terminating the present program.

On the other hand, if the answer to the aforementioned question of the step S22 is negative (No), i.e. if $KCMD_{N-1}\geqq KCMD0$, which means that the desired air-fuel ratio has a value equal to or larger than the stoichiometric air-fuel ratio, the decremental variable DKC2 and the incremental variable DKC1 are set at steps S33 to S42, and then the program proceeds to the step S43.

First, at a step S33, it is determined whether or not the WOT flag FWOT assumes a value of 1. If the answer to this question is negative (No), the incremental variable DKC1 is set to a predetermined incremental value DKC1M2 for normal operating conditions of the engine (e.g. a value corresponding to A/F=0.3) at a step S39, followed by the program proceeding to a step S42. If the answer to the question of the step S33 is affirmative (Yes), i.e. if FWOT=1, which means that the engine is in the predetermined high load operating condition, it is determined at a step S34 whether or not the immediately preceding value $KCMD_{N-1}$ of the desired air-fuel ratio coefficient is larger than a low coolant temperature desired air-fuel ratio KTWLAF to be used when the engine coolant temperature TW is low. If the answer to this question is negative (No), the program proceeds to the step S39, whereas if the answer is affirmative (Yes), it is determined at a step S35 whether or not failure in the system, such as failure in any of the related sensors connected to the ECU 5, has been detected. If the answer to the question of the step S35 is affirmative (Yes), i.e. if any relevant failure has been detected, the incremental variable DKC1 is set to a predetermined incremental value DKC1H for high engine coolant temperature (e g. a value corresponding to A/F=0.8) which is larger than the predetermined incremental value DKC1M2 for normal operating conditions of the engine at a step S40, followed by the program proceeding to the step S42.

If the answer to the question of the step S35 is negative (No), i.e. if no relevant failure has been detected, it is determined at a step S36 whether or not a high coolant temperature enriching flag FXWOT, which is set to a value of 1 when the engine is in the predetermined high load operating condition and the engine coolant temperature TW is high, assumes a value of 1. If the answer to this question is affirmative (Yes), the program proceeds to the step S40, whereas if the answer is negative (No). it is determined at a step S37 whether or not the high speed valve timing has been selected. If the answer to the question of the step S37 is negative (No), i.e. if the low speed valve timing has been selected, it is determined at a step S38 whether or not a throttle valve fully-open flag FTHWOT, which is set to a value of 1 when the throttle valve is substantially fully open, assumes a value of 1. If either of the answers to the questions of the steps S37 and S38 is affirmative (Yes), i.e. if the high speed valve timing has been selected or if the low speed valve timing has been selected and at the same time the throttle valve is substantially fully open, the program proceeds to the step S39. If both the answers to the questions of the steps S37 and S38 are negative (No), i.e. if the low speed valve timing has been selected and the throttle valve is not substantially fully open, the incremental variable DKC1 is set to a predetermined incremental value DKC1L for high load operating conditions of the engine (e.g. a value corresponding to A/F=0.05) which is smaller than the predetermined incremental value DKC1M2 for normal operating conditions of the engine at a step S41, followed by the program proceeding to the step S42.

At the step S42, the decremental variable DKC2 is set to a predetermined decremental value DKC2H on the rich side (e.g. a value corresponding to A/F=0.4). followed by the program proceeding to the step S43.

Figure 4A:
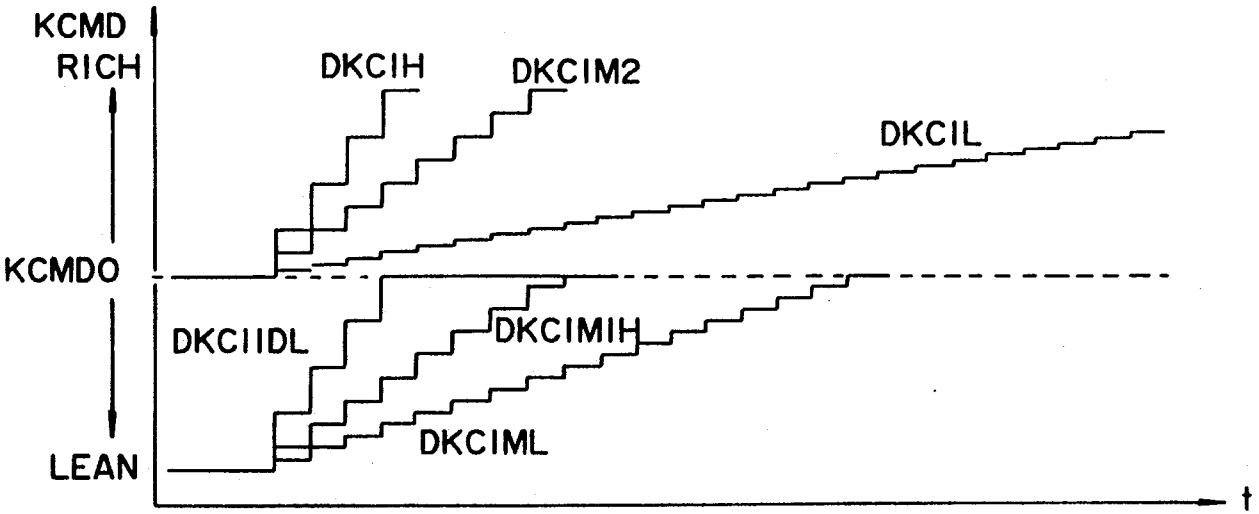
FIGS. 4*a* and 4*b* are diagrams illustrating examples of manners of change in the desired air-fuel ratio coefficient.

According to the FIG. 3 program described above, the incremental variable DKC1 and the decremental variable DKC2 equivalent to the rates of change in the desired air-fuel ratio are set in the following manner responsive to engine operating conditions:

(1) In changing the desired air-fuel ratio coefficient in an enriching direction from the value KCMD0 corresponding to the stoichiometric air-fuel ratio (as in cases shown in a region on the rich side of FIG. 4*a*):

(i) If the engine is in the predetermined high load operating condition (FWOT=1), and at the same time, any relevant failure in the system has been detected or the engine coolant temperature is so high as to require the enriching of the air-fuel ratio (FXWOT=1), the incremental variable DKC1 is set to the predetermined incremental value DKC1H for high engine coolant temperature.

(ii) If the engine is in the predetermined high load operating condition (FWOT=1), and at the same time the condition of $KCMD_{N-1} \leqq KTWLAF$ is satisfied or the high speed valve timing has been selected or the throttle valve is substantially fully open, or if the engine is not in the predetermined high load operating condition and at the same time the condition of $KCMD_{N-1} \geqq KCMD0$ is satisfied (e.g. in a case where the desired air-fuel ratio coefficient is set to a value richer than the value KCMD0 since the engine coolant temperature is low), the incremental variable DKC1 is set to the predetermined incremental value DKC1M2 for normal operating conditions of the engine.

(iii) If the engine is in the predetermined high load operating condition, and at the same time, the low speed valve timing has been selected and the throttle valve is not substantially fully open, the incremental variable is set to the predetermined incremental value DKC1L for high load operating conditions of the engine.

(2) In changing the desired air-fuel ratio coefficient in an enriching direction from a value leaner than the value KCMD0 corresponding to the stoichiometric air-fuel ratio (as in cases shown in a region on the lean side of FIG. 4*a*):

(i) If the engine is idling, the incremental variable DKC1 is set to the predetermined incremental DKC1DL for idling.

(ii) If the engine is not idling, and at the same time the engine rotational speed is low (NE<NKCMD), the incremental variable DKC1 is set to the predetermined incremental value DKC1M1H for low engine rotational speed.

(iii) If the engine is not idling, and at the same time the engine rotational speed is higher (NE≧NKCMD), the incremental variable DKC1 is set to the predetermined incremental value DKC1M1L for high engine rotational speed.

Briefly, in changing the desired air-fuel ratio coefficient KCMD in an enriching direction from a value leaner than the value corresponding to the stoichiometric air-fuel ratio, the incremental variable DKC1 is set, when the engine is idling, to a larger value than when the engine is not idling, which makes it possible to make stable the engine rotational speed immediately after transition to an idling region. Further, the incremental variable DKC1 is set to a larger value as the engine rotational speed is lower, which makes it possible to make stable the engine rotational speed when it assumes a lower value.

Figure 4B:
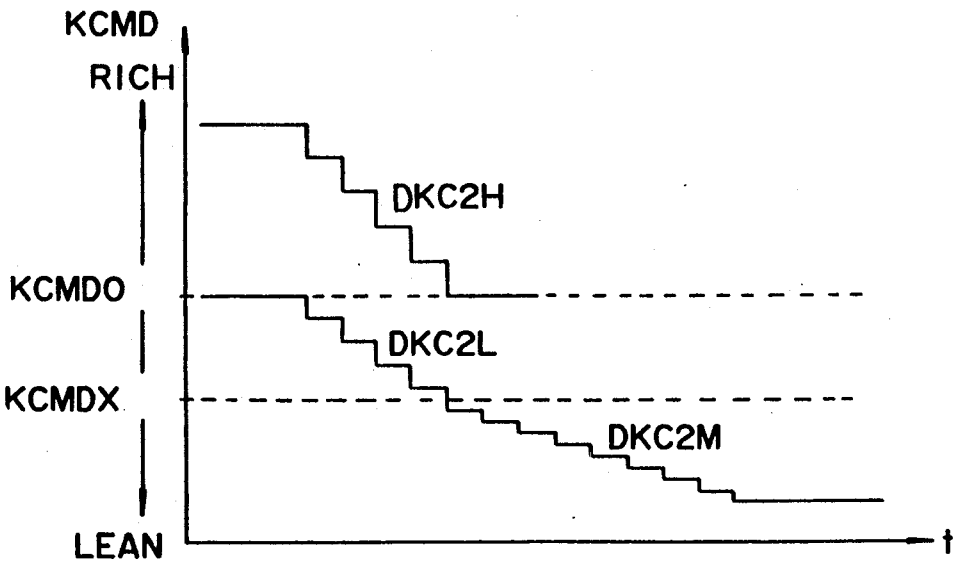

(3) In changing the desired air-fuel ratio coefficient KCMD in a leaning direction from a value richer than the value KCMD0 corresponding to the stoichiometric air-fuel ratio (as in a case shown in a region on the rich side of FIG. 4*b*):

The decremental variable is set to the predetermined decremental value DKC2H on the rich side.

(4) In changing the desired air-fuel ratio coefficient KCMD in a leaning direction from the value KCMD0 corresponding to the stoichiometric air-fuel ratio (as in cases shown in a region on the lean side of FIG. 4*b*):

(i) If the condition of $KCMD_{N-1} > KCMDX$ is satisfied, the decremental variable DKC2 is set to the first predetermined decremental value DKC2L on the lean side.

(ii) If the condition of $KCMD_{N-1} \leqq KCMDX$ is satisfied, the decremental variable DKC2 is set to the second predetermined decremental value DKC2M on the lean side.

That is, in changing the desired air-fuel ratio coefficient KCMD in a leaning direction from the value corresponding to the desired air-fuel ratio, the decremental variable DKC2 is set to a larger value until the desired air-fuel ratio coefficient KCMD reaches the predetermined lean value KCMDX than after the desired air-fuel ratio coefficient KCMD has reached the predetermined lean value KCMDX and when it is further made leaner. Consequently, the desired air-fuel ratio coefficient KCMD swiftly passes a value approximately corresponding to A/F=16, and after it has reached the predetermined lean value KCMDX, it decreases relatively gently. As a result, the time period during which the amount of emission of $NO_X$ increases is shortened, and the torque is prevented from changing drastically after the desired air-fuel ratio coefficient reached the predetermined lean value KCMDX, which enables to reduce the amount of emission of $NO_X$ while preserving good driveability.

Although the above described embodiment deals with a case where the desired air-fuel ratio coefficient KCMD is changed in a leaning direction from the value KCMD0 corresponding to the stoichiometric air-fuel ratio, the invention may also be applied to a case where the desired air-fuel ratio coefficient KCMD is changed in a leaning direction from a value leaner than the value KCMD0 corresponding to the stoichiometric air-fuel ratio.

What is claimed is:

1. An air-fuel ratio control method for an internal combustion engine having an exhaust passage, and an exhaust gas ingredient concentration sensor arranged in said exhaust passage for detecting the concentration of an ingredient in exhaust gases from said engine, wherein the air-fuel ratio of an air-fuel mixture supplied to said engine is feedback-controlled in response to output from said exhaust gas ingredient concentration sensor to a desired air-fuel ratio dependent on operating conditions of said engine, the method comprising the steps of:

(1) determining whether or not said desired air-fuel ratio is &o be changed in a leaning direction from a value equal to or leaner than a stoichiometric air-fuel ratio; and (2) changing said desired air-fuel ratio at a larger rate until said desired air-fuel ratio reaches a predetermined value than after said desired air-fuel ratio has reached said predetermined value, when said desired air-fuel ratio is to be changed in said leaning direction from said value equal to or leaner than said stoichiometric air-fuel ratio.

2. An air-fuel ratio control method according to claim 1, wherein said predetermined value is set to a value slightly leaner than an air-fuel ratio at which the amount of emission of $NO_X$ increases.

3. An air-fuel ratio control method according to claim 1, wherein said exhaust gas ingredient concentration sensor has output characteristics approximately proportional to the concentration of said ingredient in said exhaust gases.

4. An air-fuel ratio control method according to claim 2 or 3, wherein an amount of fuel supplied to said engine is determined by multiplying a basic fuel amount by a desired air-fuel ratio coefficient set in response to operating conditions of said engine and representing said desired air-fuel ratio and an air-fuel ratio correction coefficient calculated based on said desired air-fuel ratio coefficient and said output from said exhaust gas ingredient concentration sensor, to thereby feedback-control the air-fuel ratio of said mixture to said desired air-fuel ratio.

5. An air-fuel ratio control method according to claim 4, wherein said determination at said step (1) as to whether or not said desired air-fuel ratio is to be changed in said leaning direction from said value equal to or leaner than said stoichiometric air-fuel ratio comprises the steps of:

(1-1) determining whether or not an immediately preceding value of said desired air-fuel ratio coefficient is smaller than a value corresponding to said stoichiometric air-fuel ratio; and (1-2) determining whether or not a difference between a provisional present value of said desired air-fuel ratio and said immediately preceding value of said desired air-fuel ratio obtained by subtracting the latter from the former is smaller than 0.

6. An air-fuel ratio control method according to claim 5, wherein said changing of said desired air-fuel ratio at said step (2) comprises the steps of:

(2-1) determining whether or not said immediately preceding value of said desired air-fuel ratio coefficient is larger than a value corresponding to said predetermined value of said desired air-fuel ratio;

(2-2) setting a decremental variable of said desired air-fuel ratio to a first predetermined value, when said immediately preceding value of said desired air-fuel ratio coefficient is larger than said value desired air-fuel ratio;

(2-3) setting said decremental variable to a second predetermined value smaller than said first predetermined value, when said immediately preceding value of said desired air-fuel ratio coefficient is equal to or smaller than said value corresponding to said predetermined value of said desired air-fuel ratio;

(2-4) determining whether or not the absolute value of said difference between said provisional present value and said immediately preceding value of said desired air-fuel ratio coefficient is smaller than said decremental variable set at said step (2-2) or (2-3); and (2-5) obtaining a present value of said desired air-fuel ratio coefficient by subtracting said decremental variable set at said step (2-2) or (2-3) from said immediately preceding value of said desired air-fuel ratio coefficient, when the absolute value of said difference between said provisional present value and said immediately preceding value of said desired air-fuel ratio coefficient is equal to or larger than said decremental variable set at said step (2-2) or (2-3).

* * * * *